US008561361B2

(12) United States Patent
Bauletti

(10) Patent No.: US 8,561,361 B2
(45) Date of Patent: Oct. 22, 2013

(54) ANCHORING SYSTEM

(76) Inventor: Agostino Bauletti, Pozzonovo (IT)

( * ) Notice: Subject to any disclaimer, the term of this patent is extended or adjusted under 35 U.S.C. 154(b) by 0 days.

(21) Appl. No.: 13/264,753

(22) PCT Filed: Apr. 16, 2010

(86) PCT No.: PCT/IB2010/051670

§ 371 (c)(1),
(2), (4) Date: Dec. 27, 2011

(87) PCT Pub. No.: WO2010/119432

PCT Pub. Date: Oct. 21, 2010

(65) Prior Publication Data

US 2012/0096778 A1 Apr. 26, 2012

(30) Foreign Application Priority Data

Apr. 16, 2009 (IT) ..... PD2009A0091

(51) Int. Cl.
*E02D 5/74* (2006.01)

(52) U.S. Cl.
USPC ..... 52/155; 52/158; 52/159

(58) Field of Classification Search
USPC ..... 52/155, 158, 159; 256/63, 64, 35, 59; 248/156, 530
See application file for complete search history.

(56) References Cited

U.S. PATENT DOCUMENTS 2,826,281 A * 3/1958 Johnson ..... 52/158
3,809,346 A * 5/1974 Jackson ..... 248/530
3,903,662 A * 9/1975 Gabliya et al. ..... 52/741.14
4,452,018 A * 6/1984 Hill ..... 52/155
5,039,256 A * 8/1991 Gagliano ..... 405/244
5,104,074 A * 4/1992 Malloy ..... 248/156
5,243,795 A 9/1993 Roberts
5,791,635 A * 8/1998 Hull et al. ..... 256/64
5,873,679 A * 2/1999 Cusimano ..... 405/231
6,511,034 B2 * 1/2003 Nicholson et al. ..... 248/523
7,326,003 B2 * 2/2008 Gagliano ..... 405/229
2003/0066251 A1 * 4/2003 Cusimano ..... 52/169.9

FOREIGN PATENT DOCUMENTS

DE 823336 C 11/1952
EP 2009182 A2 12/2008

OTHER PUBLICATIONS

ISR and Written Opinion in PCT/IB2010/051670.

* cited by examiner

*Primary Examiner* — Mark Wendell
(74) *Attorney, Agent, or Firm* — Kristina Castellano; Castellano PLLC

(57) ABSTRACT

A ground (G) anchoring system (100) for various objects (O), such as building structures, warranties great stability, strength to mechanical stress and simplicity of installation, although having a structure of easy and economical manufacturing and comprising at least two elongated tubular guiding members (2), having a closed cross section and that are apt to define a tilted inserting direction (I), and inside which an anchoring rod (5) is inserted. The elongated members (2) are formed as distinct bodies fixed to a substantially flat developing supporting surface (1, 11), to which the object (O) to be anchored to the ground is connected and they have a longitudinal extension at least equal to about the distance (D) between two adjoining inserting end (21).

14 Claims, 5 Drawing Sheets

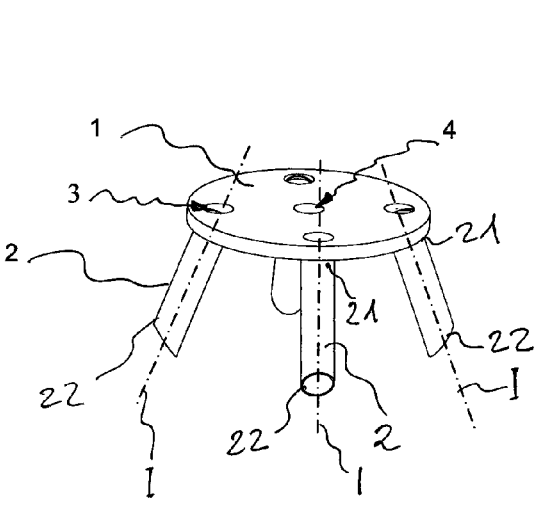
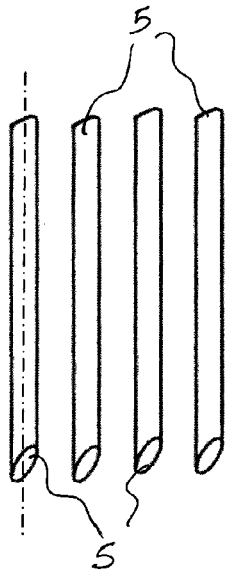
Fig. 1
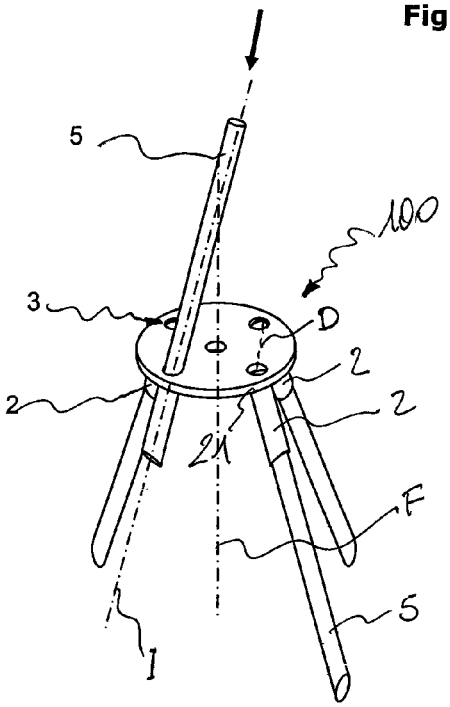
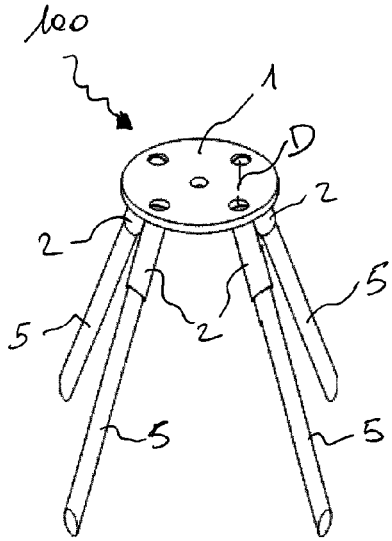
Fig. 2
Fig. 3

ANCHORING SYSTEM

CROSS-REFERENCE TO RELATED APPLICATIONS

This application is a U.S. National Stage Application of PCT/IB2010/051670 filed on Apr. 16, 2010, claiming priority to Italian application PD2009A000091 filed Apr. 16, 2009, the contents of both of which are incorporated herein by reference.

FIELD OF THE INVENTION

The present invention refers to a ground anchoring system for various kind of objects, such as building structures, comprising at least two guiding members inside which an anchoring rod is inserted, such that it is driven in the ground tilted relative to the vertical direction.

BACKGROUND OF THE INVENTION

A plurality of applications requiring resting or anchoring to the ground are known in the fields of building, installation in general, hobby, sport, agricultural.

For example, such anchoring requirement can be found in garden articles such as gazebo, spotlights and others, in sporting field with ropes or tension rods for tents, or also in road field for supporting signs or baskets in public areas, in private building for photo-electric cells and motors of electric gates.

Always as an example, other products requiring a ground anchoring are both advertising and traffic road signs or photovoltaic panels.

In case of anchoring structures with high loads, sometimes also for simple posts, on various kind of natural grounds, when the mere vertical driving is not sufficient, concrete casting both armoured and not are used. This casting, also called foundation plinth, into which log bolts or various kind of insert opposing to the mechanical loads exerted by the structure resting thereon, is characterized by their complexity and by the application time. In fact, these systems requires an excavation followed by material casting, that will be suitable for anchoring only after it has hardened.

Among the most felt evident problems during the realization of the hereby described anchorage on this kind of grounds, there is the difficulty in optimizing the stability of the anchored structure. The ground is often subjected to settling as it has been removed in order to obtain the anchoring site and restored upon completed anchorage. In any case in each of the previously described methods, both patented and not, a system which is sequentially removable and successively even reusable has been never disclosed. Last, but probably even more relevant there is the installation cost of the above mentioned systems, cost determined by installation times and by the required labour.

Other anchoring techniques which do not require excavation and cementing exist, which substantially consists of driving posts, screw system, variously shaped and sized anchors in the ground with mechanical or manual systems. With reference to posts and screw systems, although being an effective solution when loads and mechanical forces urging on the structure are not particularly severe, they have remarkable limits concerning the resistance to traction. In fact, their resistance is determined only by the pressure exerted by the material into which they are driven against the wall of the object itself. Accordingly, the lateral shaking of the post remarkably reduces the anchorage strength. The system with an anchor buried deep in the ground somehow overcome this problem, even if it is less effective in withstanding lateral and vertical pressures exerted on the supported structure and it is also particularly expensive in its realization and limited in being applicable only for resistance to traction. All the above mentioned system are sensitive to the variations of the ground compaction conditions and to the driving-in depth. Patent literature offers several examples also in this case, such as the Italian patent IT 1177338 to Sistemi Chiocciola S.r.1. Nevertheless, the screw system driving in the ground has some problems during installation as the screw could go down with a certain tilting without allowing a perfect verticality to the ground of the structure that will support, as long as particularly complex machineries are used. Moreover, in the case of rocky bottom this kind of system cannot be installed and also the above mentioned ones could be installed with great difficulties at least without a preliminary perforation of a certain amount.

As an alternative to such systems also anchoring systems exist that envisage the installation of a supporting structure to the object to be anchored, the former being fixed to the ground by means of rods to be inserted tilted in the ground through apposite guides.

One example of such system is described in U.S. Pat. No. 2,826,281, using a ring to be fixed around a post onto which a set of rods can be inserted, that are driven in the ground, through apposite guides.

Nevertheless, this solution does not provide sufficient stability to the structure and, in fact, requires the use of a concrete casting in connection to the rods for maintaining stabile the structure.

Moreover, also in this case, the system requires a excavation step, with a consequent placing of the structure beneath ground, thus making the installation difficult. In general, moreover, the employed guides have excessively shorts dimension allowing to drive the rods only according to a limited tilting, without offering any structural stiffness. In fact, in confirmation of this, it can be noted that the structure should be necessary buried in a concrete casting, or it does not provide sufficient stability.

As an alternative to such system, the European patent EP 483 158, also relative to the use of tilted rods for anchoring an object to the ground, describes the use of elongated stones provided with staggered holes for guiding the rods. On the contrary, in this case the presence of the holes is critical as the risk of excessively inserting the rod in the hole, thus passing over it, exists, compromising the guiding function normally achieved by the pair of holes. Moreover, the rods can also pass over during the use of the anchoring system, i.e. after the installation thereof, as lateral oscillations of the anchored object could produce small movements in the rods that, in the long run, would cause the passing over thereof. According to an alternative embodiment, the patent describes the use of posts provided with a series of through holes, into which inserting the rods, that can be directly inserted in the ground. Nevertheless, in this case the structure is hardly suitable for fixing small objects and, moreover, it necessary requires a preliminary working of the object to be anchored.

BRIEF SUMMARY OF THE INVENTION

Accordingly, the technical problem underlying the present invention is to provide an anchoring system allowing to overcome the drawbacks mentioned above with reference to the known art.

Such problem is solved by the anchoring system according to the embodiments set forth herein.

The present invention provides several relevant advantages. The main advantage lies in that the anchoring system according to the present invention warranties great stability, strength to mechanical stress and simplicity of installation, although having a structure of easy and economical manufacturing.

In particular, it does not require any preliminary work either of the ground nor of the object to be anchored before the use thereof and can be used substantially on any kind of ground.

Moreover, the anchoring is possible immediately after the installation as, since it does not modify the condition of the soil, it does not require settling times or material hardening.

BRIEF DESCRIPTION OF THE SEVERAL VIEWS OF THE DRAWINGS

Other advantages, features and the operation modes of the present invention will be made apparent from the following detailed description of some embodiments thereof, given by way of a non-limiting example. Reference will be made to the figures of the annexed drawings, wherein:

FIG. 1 is a perspective view of a first embodiment of the anchoring system according to the present invention, wherein anchoring rods are removed from a respective supporting structure;

FIGS. 2 and 3 are perspective views of the anchoring system of FIG. 1 during an assembling step and after assembling, respectively;

DETAILED DESCRIPTION OF THE INVENTION

Figure 4:
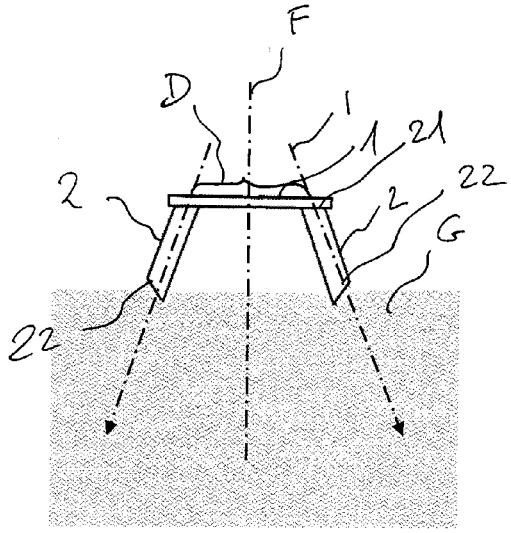
FIGS. 4 to 7 are front views schematically showing installation steps of the system of FIG. 1 and the distribution of forces during the use thereof.

With reference initially to FIGS. 1 to 3, a ground anchoring system G for various kind of objects, such as building structures, according to the present invention is in general shown with the reference number 100. The system comprises at least two elongated tubular guiding members 2, preferably three, inside which a respective anchoring rod 5 is inserted at a inserting end 21, the anchoring rod being at least twice long that the elongated members. Obviously, as it will be in seen in greater detail, the correct sizing of the rod 5 will be connected to the specific application and, by means of the present description, a person skilled in the art will be able to make this designing choices.

The elongated members 2 are fixed to a supporting surface that can be variously shaped and sized and made of various materials according to the practical application and to the requirement determined by the mechanical load exerted on the base by the structure to be anchored and by the type of bottom onto which the anchoring is required. In the present embodiment the structure 1 is resting on the ground and it is fixed thereto by means of the at least two anchoring rods 5, preferably three, in a manner that will be better described in the following. It is evident that a greater number of anchoring rods can offer more constraints and a better anchoring stability. As previously mentioned, the anchoring rods 5 can have various length, but also section, and they can be realized in various materials, always according to the requirements determined by the kind of bottom and by the mechanical load to be supported. In addition, their surface can also be smooth or knurled, solid or hollow. In conclusion, the sizing of the supporting surface and of the anchoring rods will be substantially determined by two variables: the structure to be supported and the kind of bottom onto which performing the anchoring.

Always with reference to FIGS. 1 to 3, the elongated members 2 has a closed cross section and are apt to define a inserting direction I, in which the anchoring rods 5 are inserted, as can be seen in FIG. 2.

Figure 7:
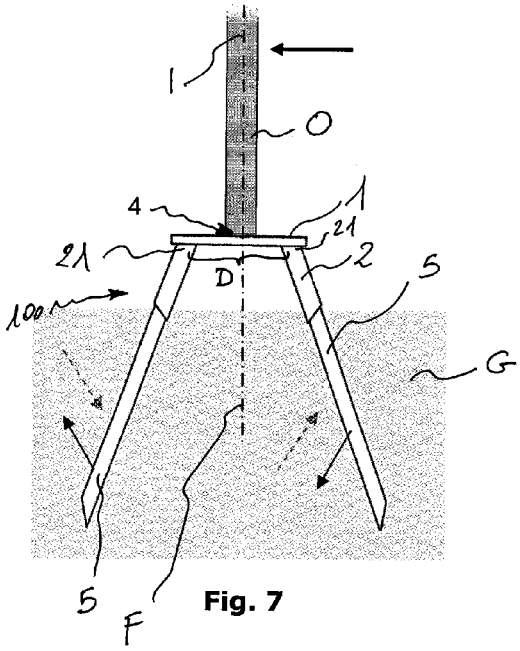
Figure 8:
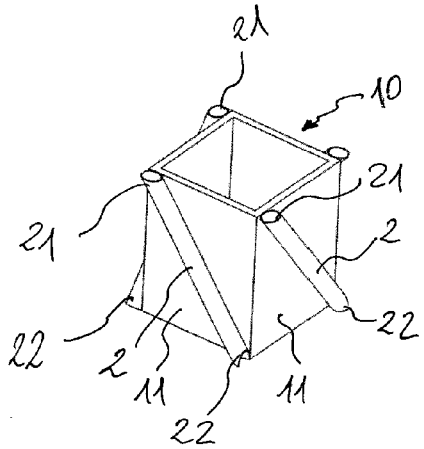
FIG. 8 shows the anchoring system according to an alternative embodiment, wherein anchoring rods are removed from a respective squared section supporting structure.
Figure 8:
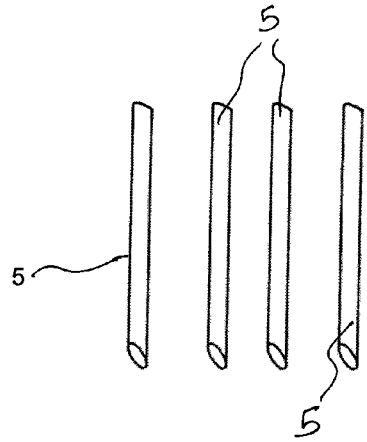
Figure 9:
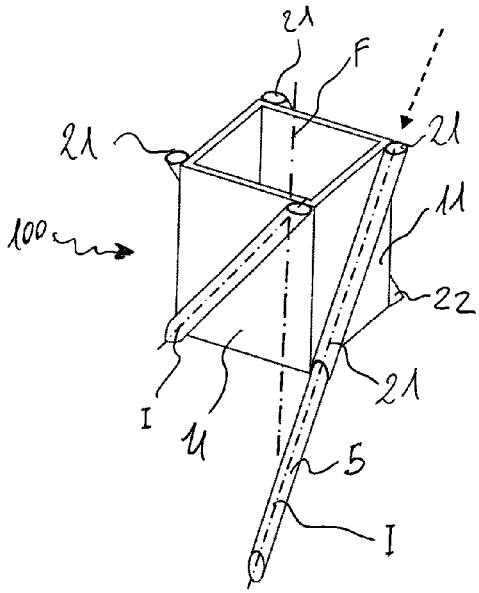
FIGS. 9 and 10 are perspective views of the anchoring system of FIG. 8 during an assembling step and after assembling, respectively.
Figure 10:
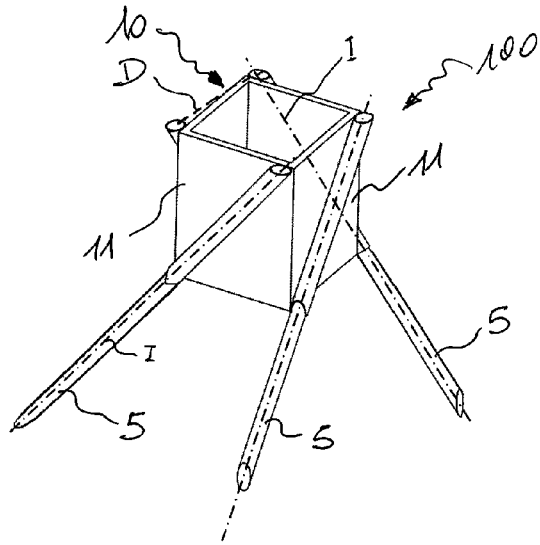
Figure 11:
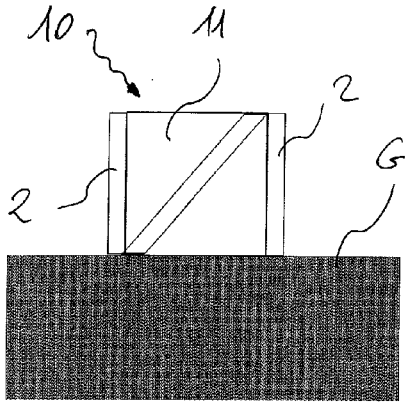
FIGS. 11 and 12 are front views schematically showing an installation step and an exemplificative use of the system according to the present invention, respectively.

The inserting directions I are tilted to a fixing direction F, substantially perpendicular to the ground G, as can be seen in FIGS. 4 and 7. In particular, the elongated members 2 are made as separated bodies fixed to the supporting surface 1, e.g. by means of welding. The supporting surface 1 has a substantially flat development, and has connecting means for connection to an object O to be anchored to the ground. For example, in the present embodiment such connecting means are formed by a central hole 4 onto which the object O can be fixed.

In the present embodiment, the structure 1 is formed by a circular plate, substantially disk-shaped, placed substantially parallel to the ground G in use. The plate has four holes 3 in correspondence of which four respective members 2 are fixed, preferably by welding, at the inserting end 21, so as to allow the inserting of said rods 5.

In the system according to the present invention the elongated members 2 are designed such that they have a longitudinal extension at least equal to about the distance D between two adjoining inserting ends 21. In fact, in this manner, as will be better understood in the following, the tubular members 2 and the supporting surface will be placed at least partially above ground G in use. Such distance D can be simply defined as the length of the shortest segment allowing to connect the inserting ends 21 of two elongated members 2.

In greater detail, besides the inserting end 21, the elongated members 2 comprises an exit end 22 resting or inserted in the ground G.

In the present embodiment, the elongated members 2 has a tilting such that the exit end 22 is placed at a greater distance from the axis defining the fixing direction F than the inserting end 21.

As a consequence, the elongated members 2 develops from the holes 3 of the plate 1 according to a substantially radial direction.

Therefore, it is apparent that the elongated guiding members 2 will have the function of directing the anchoring rods 5 during their penetration in the ground G. The members for the rods could be welded to the surface 1 with a predetermined tilting, that will be anyhow non-zero relative to the axis of the surface 1 corresponding with the axis F. To this regard, the FIG. 5 is explanatory, showing the installation to a bottom by a bi-dimensional representation.

More precisely, the system installation to the ground and the representation of the provided anchoring effect after installation is shown in FIGS. 4 to 7. The bi-dimensional representation with the use of only two rods allow to simplify the representation of the provided effect.

Once resting on the ground, the anchoring rods 5 are inserted inside the elongated members 2 and moves down towards the ground by means of a mechanical thrust, passing through the structure 1 with obliquity determined by the members 2, as can be seen in FIG. 4. The members 2 form an integral part of the structure itself, their tilting to the axis defined by the fixing direction F finally determining poi the clamping of the object and that can be welded in order to direct to the insert with any tilt different from the one of the above mentioned axis. The simple opposition of the inserting directions of the anchoring rods provides that once all of the them are installed in their seats the escape thereof is not possible for any direction of the mechanical force exerted on the base. In fact, in this way, it is not advantageously required a further clamping of the anchoring rods on the supporting structure, opposite to known systems. Anyhow, it is evident that in case a welding thereof can be provided after the object is fixed or a fixing shape of the anchoring rods 5 end can be provided during the manufacturing of the object.

Figure 5:
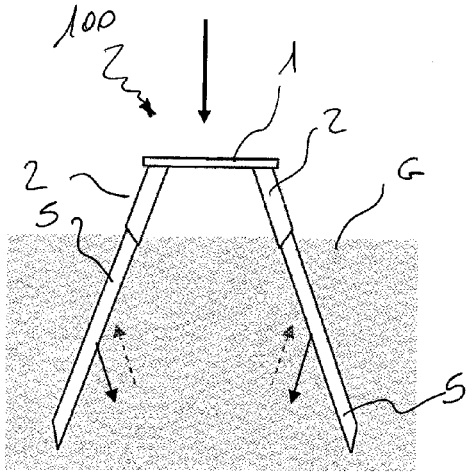
Figure 6:
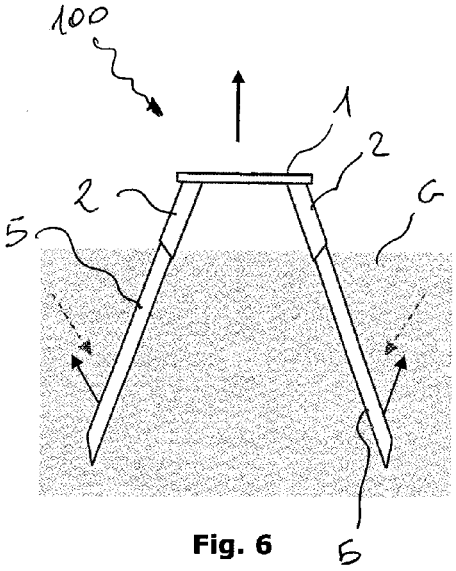

As shown the FIGS. 5, 6 and 7, once the system is installed, it provides a sort of joint capable of opposing to the mechanical stress determined by the result of the opposed forces holding the anchoring rods to the ground. The mechanical forces exerted by the object O anchored on the surface 1 and the forces that in turn load it are discharged on the mass into which the rods are immersed. Then the hold of the anchoring will be effective until when the ground or the objects yields. Obviously, the greater the cohesion of the material forming the ground is and the stronger the materials with which the object is realized are, the more effective will be the anchoring.

FIG. 5 shows in a extremely simplified manner as a pressure on the surface 1 opposes to the penetration strength of the ground by the surface of the obliquely placed rods. Analogously, FIG. 6 shows as a force exerted along the axis of the supporting surface 1 in an opposed direction to the ground opposes to the mass urging above the anchoring rods 5. Once again the mass amount opposing to this load will be determined by the cohesion of the material forming the ground itself and the area concerned by the rods 5, the more long and tilted they could be.

In order to represent the members opposing to a lateral pressure, in FIG. 7 it is shown a vertical development object O fixed to the supporting surface 1 by the central hole 4. In this case a force exerted perpendicularly to the vertical structure generates a rotation effect determined by the mechanical moment between rods, surface, object and ground. In this case, a kind of composition of the effects of FIGS. 5 and 6 varying relative to axis F of the supporting surface 1 will oppose to the movement. From the side from which the lateral pressure is provided there will be a similar effect to the one of FIG. 6, i.e. the pressure of the bottom on the anchoring rods moving down obliquely in such direction will oppose. From the opposed side the effect will be instead the one of FIG. 5, and in fact the penetration strength of the rods by the ground will oppose. Moreover, it can be understood how the anchorage type can oppose a strength to a force tending to twist the supporting surface relative to the elongated members.

It will be understood that the present invention is susceptible of several embodiments alternative to the one described hereto, some of which are briefly described hereinafter with reference to the sole aspects differentiating them from the first embodiment considered hereto.

Then, in FIGS. 8 to 13 a second embodiment del anchoring system according to the present invention is shown.

In particular, in this case, the supporting surface 11 corresponds to a lateral surface of a hollow supporting structure 10, in particular box shaped.

More precisely, the supporting surface 11 will be substantially perpendicular to the ground G in use, unlike the previous case.

Figure 12:
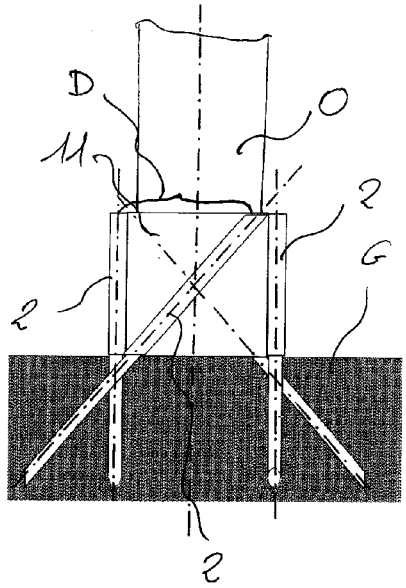
Figure 13:
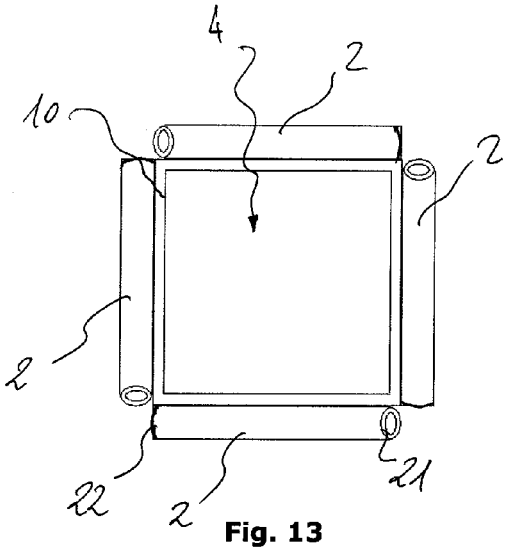
FIG. 13 is a top view of the system of FIG. 8.

Then, as can seen from FIG. 12, in this case the object O could be advantageously supported inside the hollow supporting structure 10, with requiring any further fixing systems.

Nevertheless, it is evident that suitable fixing means could be also provided allowing to clamp the object inside the hollow structure 10. In particular, once the object is inserted inside the hollow a series of through screws, not shown in figure, can be provided in the industrial manufacturing, allowing to clamp the object inside it and at the same time, in case, to adjust the verticality thereof.

According to a preferred embodiment, the supporting structure 10 is parallelepiped shaped, wherein the lateral surfaces correspond to a lateral faces of the parallelepiped.

Then, the elongated members 2, preferably fixed by welding to the faces 11, will extend substantially between two opposed vertexes of such faces 11, so as to advantageously provide a great stability to the structure, the size thereof being minimal.

By way of example, such embodiment could be advantageously used as a base for the supporting leg for a gazebo in a garden, ad a post per the signs in a public garden or on the road.

Figure 14:
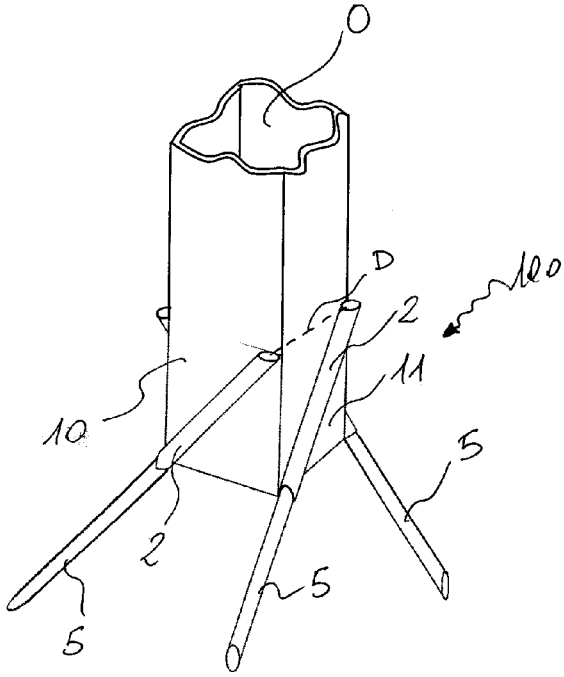
FIGS. 14 and 15 show further alternative embodiments of the system according to the present invention.

With reference to FIG. 14, a further embodiment is shown, in particular based on the embodiment hereby described.

In particular, it can be noticed that in this case the supporting structure 10 corresponds to a end portion of the object O, and, as a consequence, the elongated members 2 are directly fixed to the end portion of the object O.

Figure 15:
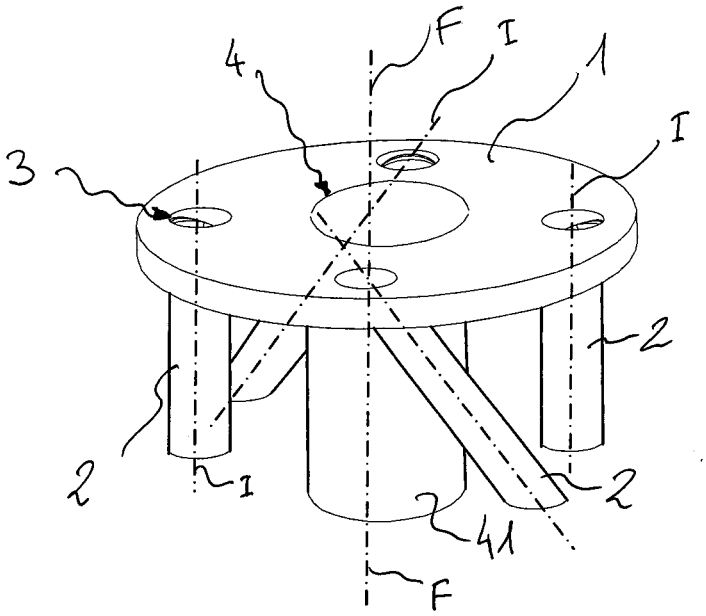

Then, with reference to FIG. 15, a further embodiment base on the use of the previously described disk-shaped plate 1 is shown. In particular, in this case, the plate 1 comprises a elongated hollow fixing member 41, placed at the opening 4 forming the central hole. The fixing member 41 extends substantially parallel to the fixing direction F and can house therein a portion of the object O, formed e.g. by the end portion of a post. Moreover, it can be appreciated that in the anchoring system according to the present embodiment, the elongated members 2 develops from said holes 3 in the plate 1 according to a substantially tangential direction.

Although in both the exemplificative embodiments shown reference has been made to the presence of four anchoring inserts, it is confirmed that the working principle of the invention requires a minimum of two rods up to a undefined maximum number, that will have to meet the effectiveness and efficiency principles. Clearly in the industrial manufacturing the mechanical design determined by the anchored structure and by the bottom to which the anchorage is required as well as of the manufacturing and installation costs of the system should be taken into account. It also explained that a precise mechanical machining is not required for the practical manufacturing of the object as the principle involved is not bind by precision.

The one hereto described represent only some of the applications of the anchoring system according to the present invention.

In particular, the system can be accordingly designed for supporting light posts or for supporting electrical or telephone cables, for supporting groundwork structures in housing and industrial building fields. In fact, the principle on which the invention is based can be applied on different scale and design in order to obtain the desired mechanical strength for the type of structure and per the type of bottom lodging the anchorage.

The present invention has hereto been described with reference to preferred embodiments thereof. It is understood that there could be other embodiments referable to the same inventive kernel, all falling within the protective scope of the claims set forth hereinafter.

The invention claimed is:

1. A ground (G) anchoring system for objects (0), comprising at least two elongated tubular guiding members inside which an anchoring rod is inserted, the anchoring rod being longer than the elongated tubular guiding members, said elongated tubular guiding members having a closed cross section and defining an inserting direction (I) of said anchoring rods, said inserting directions (I) being tilted with respect to a fixing direction (F) substantially perpendicular to the ground (G), said elongated tubular guiding members having a length at least equal to about the distance (D) between two adjoining inserting ends, such that, in use, said elongated tubular guiding members are of sufficient size to be at least partially placed above ground (G), and further comprising a supporting structure, each elongated tubular guiding member being formed as distinct bodies and being fixed externally to lateral surfaces of the supporting structure, corresponding to substantially flat developing supporting surfaces to which the object to be anchored to the ground may be connected, and said supporting surface being configured such that it is at least partially placed above ground (G) in use and substantially perpendicular to the ground.

2. The anchoring system according to claim 1, wherein said substantially flat developing supporting surface is formed by a plate placed substantially parallel to the ground (G) in use, said plate having at least two holes corresponding to which said elongated members are fixed so as to allow the insertion of said rods.

3. The anchoring system according to claim 1, wherein the supporting structure is hollow, said object (0) is being supported inside said hollow supporting structure.

4. The anchoring system according to claim 3, further comprising fixing means of said object inside said hollow supporting structure.

5. The anchoring system according to claim 1, wherein said supporting structure is parallelepiped shaped, said lateral surfaces corresponding to lateral faces of the parallelepiped.

6. The anchoring system according to claim 5, wherein said elongated tubular guiding members extend substantially between two opposed vertexes of said face.

7. The anchoring system according to claim 1, wherein said supporting structure corresponds to an end portion of said object (0), and said elongated tubular guiding members being directly fixed to said end portion of the object (0).

8. A ground (G) anchoring system for objects (0), comprising at least two elongated tubular guiding members inside which an anchoring rod is inserted, the anchoring rod being longer than the elongated members, said elongated tubular guiding members having a closed cross section and defining an inserting direction (I) of said anchoring rods, said inserting directions (I) being tilted with respect to a fixing direction (F) substantially perpendicular to the ground (G), said elongated tubular guiding members being formed as distinct bodies fixed to a substantially flat developing supporting surface, to which the object (0) to be anchored to the ground (G) is connected, wherein:

a. said elongated tubular guiding members has a length at least equal to about the distance (D) between two adjoining inserting ends, such that, in use, said elongated tubular guiding members and said supporting surface are at least partially placed above ground (G), b. said substantially flat developing supporting surface is formed by a single plate placed substantially parallel to the ground (G) in use, said plate having at least two holes corresponding to said elongated tubular guiding members which are fixed so as to allow the insertion of said rods, and c. said inserting end is fixed corresponding to said holes and said elongated tubular guiding members project from a single side of said plate and comprise an exit end remote from the plate and insertable in the ground (G).

9. The anchoring system according to claim 8, the elongated tubular guiding members are tilted such that said exit end is placed at a greater distance from the axis defining said fixing direction (F) than said inserting end.

10. The anchoring system according to claim 8, wherein said plate has a substantially central opening for fixing the object (0) to be anchored.

11. The anchoring system according to claim 8, wherein said plate comprises an elongated hollow fixing member, placed corresponding to said opening and extending substantially parallel to the fixing direction (F).

12. The anchoring system according to claim 8, wherein said plate is disk-shaped.

13. The anchoring system according to claim 8, wherein said elongated tubular guiding members develop from said holes of the plate according to a substantially radial direction.

14. The anchoring system according to claim 8, wherein said elongated tubular guiding members develop from said holes of the plate according to a substantially tangential direction.

* * * * *